US007198070B1

(12) United States Patent
Hansen et al.

(10) Patent No.: US 7,198,070 B1
(45) Date of Patent: Apr. 3, 2007

(54) ASSEMBLING AEROSOL CONTAINER PACKAGES

(75) Inventors: Eric J. Hansen, Ada, MI (US); Timothy S. Parker, Rockford, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 269 days.

(21) Appl. No.: 10/711,483

(22) Filed: Sep. 21, 2004

Related U.S. Application Data

(60) Provisional application No. 60/481,413, filed on Sep. 24, 2003.

(51) Int. Cl.
*B65B 1/04* (2006.01)

(52) U.S. Cl. ..... 141/3; 141/20; 141/94

(58) Field of Classification Search ..... 141/2, 141/3, 20, 18, 94, 171; 222/145.5, 145.1, 222/135; 239/304; 53/88
See application file for complete search history.

(56) References Cited

U.S. PATENT DOCUMENTS 2,613,023 A 10/1952 Reich
3,880,207 A * 4/1975 Giuffredi ..... 141/20
3,995,666 A * 12/1976 Michaels ..... 141/3
7,021,499 B2 * 4/2006 Hansen et al. ..... 222/145.5

* cited by examiner

*Primary Examiner*—Steven O. Douglas
(74) *Attorney, Agent, or Firm*—McGarry Bair PC

(57) ABSTRACT

A process of filling containers includes a passivating the filling equipment immediately prior to filling the containers with an oxidizing composition. Adjacent containers filled with different compositions are oriented relative to each other by marking the containers with a visible indicia representative of a pick up point of a dip tube within the container, rotating the containers relative to each other until the pick up point of each dip tube is positioned is a predetermined relationship to each other and thereafter adhering the containers are to each other in the predetermined relationship.

10 Claims, 5 Drawing Sheets

ASSEMBLING AEROSOL CONTAINER PACKAGES

CROSS-REFERENCE TO RELATED APPLICATIONS

This application claims the benefit of U.S. Provisional Application Ser. No. 60/481,413, filed Sep. 24, 2003.

FIELD OF THE INVENTION

This invention relates to a process of assembling aerosol container packages. In one of its aspects, the invention relates to a process for filling aerosol containers. In another of its aspects, the invention relates to a process for assembling filled containers into a dual container cleaning solution package. In yet another of its aspects, the invention relates to an apparatus for assembling filled containers into a dual container cleaning solution package.

DESCRIPTION OF THE RELATED ART

U.S. patent application Ser. No. 10/604,780, the entirety of which is incorporated herein by reference, discloses a manual spray cleaner comprising two adjacent containers adhered to each other and further bound by a shrink-wrap label. Each container holds a pressurized liquid, one containing a cleaning composition and the other an oxidizing composition. The oxidizing composition, also known as a peroxygen compound, can be any active oxygen-containing compound. The preferred peroxygen compound is a high purity hydrogen peroxide. A dip tube extends to the bottom of each container from a valve at the top. An actuator mounted to the tops of the containers provides a single outlet for the contents of both.

Each container is filled by a conventional filling operation. FIG. 1 illustrates an example of a known process 10 for filling aerosol containers with cleaning composition and/or oxidizing composition using conventional filling equipment. Conventional filling equipment typically comprises mostly stainless steel. Although stainless steel typically has good resistance to oxidation, small amounts of iron or other metals present in the alloy can react when in contact with an oxidizing agent. Consequently, before the filling equipment is ever used, it is subjected to a passivation step 12. The passivation step 12 is a conventional oxidation-reduction process to reduce potential reactivity of free metals in the filling equipment. The passivation step 12 typically utilizes an oxidizing agent, such as nitric acid ($H_2NO_3$), flushed through the filling equipment at a concentration that effectively reacts with free metals to render them non-reactive to any oxidizing agents that follow in a conventional filling operation. In other words, the passivation step 12 renders the filling equipment passive to subsequent oxidation.

Subsequent steps include batch filling a predetermined number of containers with cleaning composition 14 and batch filling a predetermined number of containers with oxidizing composition 16. The order of filling is typically not significant, dependant upon the need for a particular product. It may be that a number of batch fillings for cleaning composition 14 occur before any batch filling of oxidizing composition 16. However, typically before any batch filling of oxidizing composition, a flushing step 18 occurs. If an oxidizing agent, such as hydrogen peroxide $H_2O_2$, is in the oxidizing composition for filling a container, it will react with any trace metals or organics in the filling equipment, triggering the release of free oxygen, $O_2$, from the oxidizing composition, thereby changing the nature of the composition itself. The potential for this type of reaction makes it difficult to maintain consistency in the oxidizing composition from one container to the next.

The flushing step 18 typically flushes the filling equipment with water or diluted cleaning solvents before it is used to fill containers with an oxidizing composition. But this type of typical cleaning operation does very little to decrease the reactivity of steel components and trace metals with oxidizing agents. And it also does not necessarily flush out all residual organics from prior filling operations. A problem thus remains in that the passivation process is usually a one-time event. No provision is made for subsequent reactivity between the filling equipment and an oxidizing composition.

An aerosol spray bottle typically contains a siphon or dip tube that extends from a valve at the top of the container to the bottom of the container in order to assure evacuation of as much product from the container as practicable. For a single aerosol spray bottle where, in use, the container may be at an angle, the dip tube may be long enough to reach the circumference of the bottom of the container. The pick-up point at the lower end of the dip tube will preferably be oriented in the same direction as the direction the valve is pointed at the top of the container so that when the container is angled in use, product otherwise pooling at the lowest point of the container will continue to be drawn through the dip tube. However, positioning two separate aerosol containers together as described in U.S. patent application Ser. No. 10/604,780 presents a problem in orienting the containers so that pick up points of both dip tubes will be largely oriented in the same direction.

SUMMARY OF THE INVENTION

According to the invention, a process for batch filling containers with an oxidizing composition by means of filling equipment comprises the step of passivating the filling equipment immediately prior to batch filling. Typically, the oxidizing composition to be filled in the containers comprises a peroxygen compound, preferably hydrogen peroxide. The passivating step includes flushing the filling equipment with an oxidizing agent such as a nitric acid composition.

The process according to the invention can further include the step of orienting adjacent aerosol containers relative to a reference plane. Each aerosol container has a valve stem, a dip tube, a pick up point on the dip tube within the container and a longitudinal axis lying in the reference plane, wherein the process includes marking each container with a visual indicia at a predetermined relationship to the pick up point, detecting the position of the visual indicia relative to the reference plane and rotating each container until the visual indicia is within a predetermined relationship to the reference plane.

Furthermore, the two adjacent aerosol containers that are filled with different compositions can be secured together in a predetermined relationship relative to the reference plane. In one embodiment of the invention, the securing step includes gluing the containers together. In another embodiment of the invention, the securing step includes binding the containers together with a shrink-wrap material either individually or in combination.

The process preferably includes orienting the adjacent aerosol containers with the longitudinal axes of the adjacent aerosol containers lying within the reference plane and oriented so that the visual indicia of each of the adjacent containers are aligned in the same direction within about 45° of the reference plane, preferably within about 22° of the reference plane.

In another embodiment, the two adjacent and oriented aerosol containers are securing together in the predetermined relationship to the reference plane. In a preferred embodiment, the process includes the further step of applying to the valve stems of the adjacent containers a dispensing actuator that has a dispensing opening that is directed along the reference plane.

The oxidizing composition, also known as a peroxygen compound, that is filled in one of the containers can be any active oxygen-containing compound. The preferred peroxygen compound is a high purity hydrogen peroxide. Examples of peroxygen compounds are found in U.S. Pat. No. 6,187,738 to Micciche, et al., which is incorporated herein by reference.

DETAILED DESCRIPTION

Passivation Process

Figure 1:
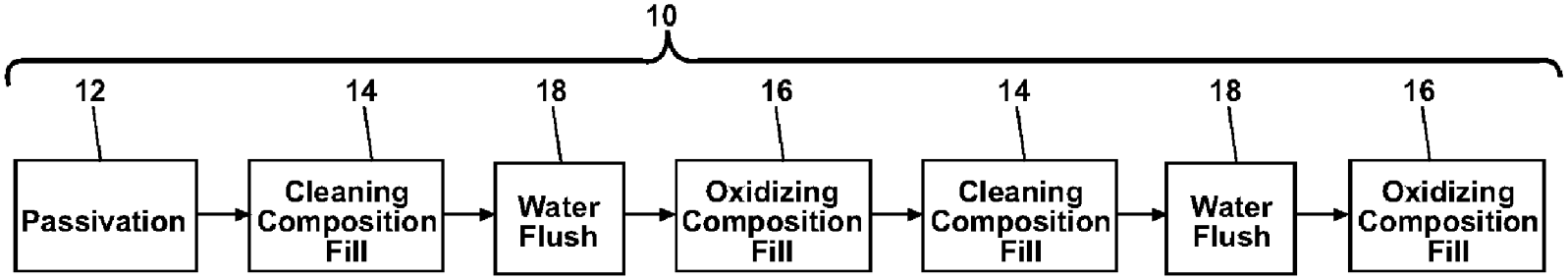
FIG. 1 is a schematic diagram of a prior art process for filling aerosol containers with cleaning composition and oxidizing composition.
Figure 2:
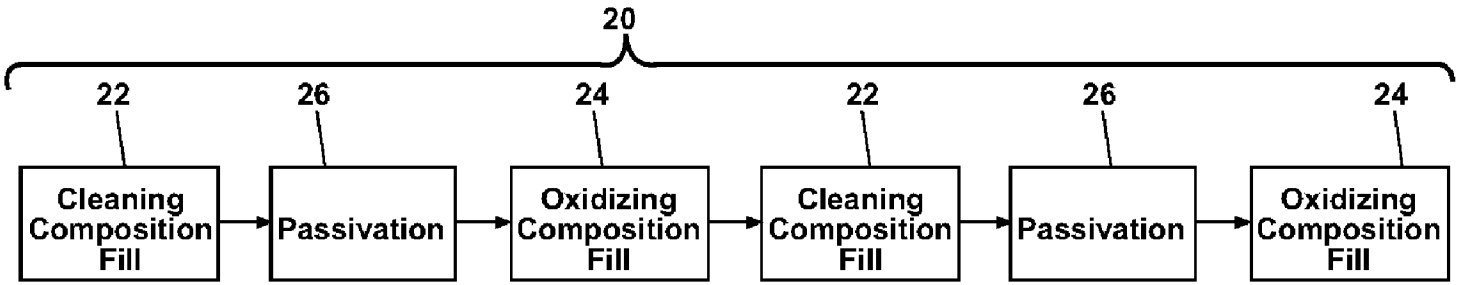
FIG. 2 is a schematic diagram of a process, according to the invention, for filling aerosol containers with cleaning composition and oxidizing composition while maintaining the integrity of the oxidizing composition.

FIG. 2 illustrates an improved process 20 for batch filling aerosol containers with a cleaning composition 22 and for batch filling aerosol containers with an oxidizing composition 24 on the same filling equipment, while maintaining the integrity of the oxidizing composition. Here, as in the prior art, the filling process is a batch process. In other words, a predetermined number of containers are filled with the same composition in single batch. To fill containers with another composition requires running a new batch. Importantly, regardless of the order in which batches are run, the improvement comprises always running a passivation step 26 immediately prior to batch filling containers with an oxidizing composition 24. This improvement insures the passivation of any trace metals or organics that may have been introduced by filling containers with another non-oxidizing composition.

Thus, for example, filling a batch of containers with a cleaning composition may leave some trace metals or organics in the filling equipment that may not be completely removed by conventional water flushing. To maintain the integrity of a subsequent oxidizing composition during the filling process, the passivation step is run immediately before batch filling with the oxidizing composition. The passivation step 26 is itself conventional, as described for example above.

Figure 3:
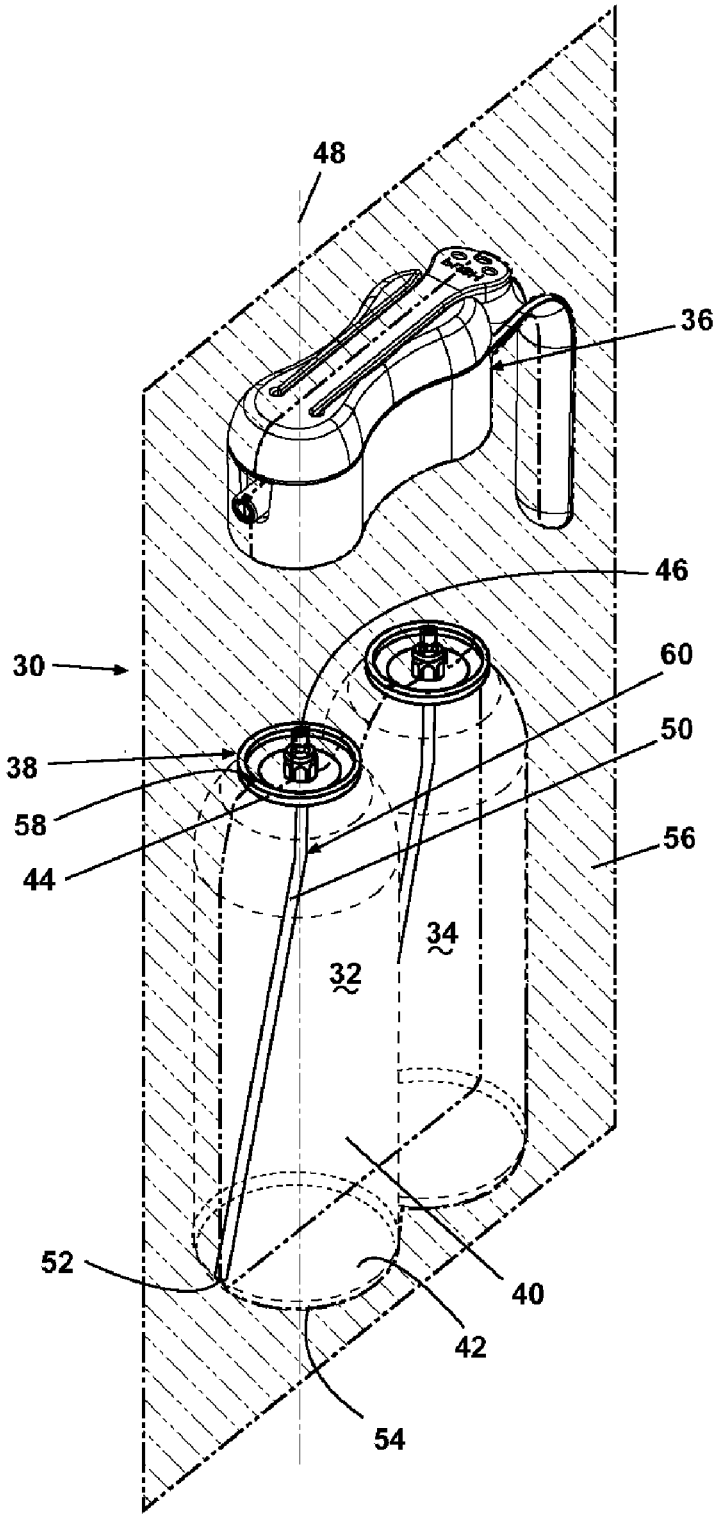
FIG. 3 is an exploded perspective view of manual spray dispenser as it would be assembled according to the invention.

FIG. 3 illustrates the components of a manual spray dispenser 30, as it would be assembled according to the invention, including a first aerosol container 32 filled with cleaning composition and a second aerosol container 34 filled with oxidizing composition. Each container 32, 34 is shown in phantom for clarity. An actuator 36 that is assembled to the containers is shown in exploded view for clarity. Referring now only to either one of the containers (here, container 32), it will be understood that in the process for filling the container 32, it is first filled with product, and then moved to a valve station where it receives a valve assembly 38 loosely in the top of the container. The container 32 is generally cylindrical having a sidewall 40 and a bottom wall 42. The valve assembly 38 comprises a valve cup 44, a valve stem 46 projecting upwardly from the valve cup along a longitudinal axis 48 of the container, and a dip tube 50, operatively connected to the valve stem 46, and projecting downwardly from the valve cup into the container. The dip tube 50 is long enough so that its pick-up point 52 at the end of the tube is at or near a circumferential edge 54 of the bottom wall 42 at the intersection of the bottom wall 42 and sidewall 40 of the container. FIG. 3 also shows an imaginary plane 56 intersecting the pick-up point 52 and the longitudinal axis 48. A visual indicia 58 is placed somewhere on the container 32 where the imaginary plane 58 intersects an outer surface of the container. Preferably, a permanent bend or curve 60 is provided in the dip tube 50, in which case the visual indicia 58 is a mark is placed on the valve cup 44 at the intersection of the imaginary plane 56 and the valve cup 44 before the valve assembly 38 is received in the container 32.

The filled container 32 with the valve assembly 38 then passes to a pressurization station (commonly called a "gas house"), where in conventional manner, the valve cup 44 is crimped to the container 32, closing the container, and propellant is added to the container through the valve stem 46 to a predetermined pressure. In the manual spray dispenser assembled according to the invention, each container thus filled will then have a visual indicia showing the location of the pick-up point of each corresponding dip tube, relative to the container. The visual indicia can be a mark comprising ink, paint or any other material substance in which at least part of the substance remains in a detectable form. The mark could also be as any material such as a label or sticker, which is glued, fastened, or otherwise attached to the container or valve assembly. The mark could also be any notch, protrusion, or non-uniform feature in the container or valve assembly from which the orientation of the dip tube can be interpreted.

In the present process where two containers comprising different compositions are to be adjoined, the marks of those containers bearing one composition are preferably distinguishable from the marks of those containers bearing the other composition. The batch-filled containers are stored according to their compositions until assembly of the manual spray dispenser.

Orientation Process

Figure 4A:
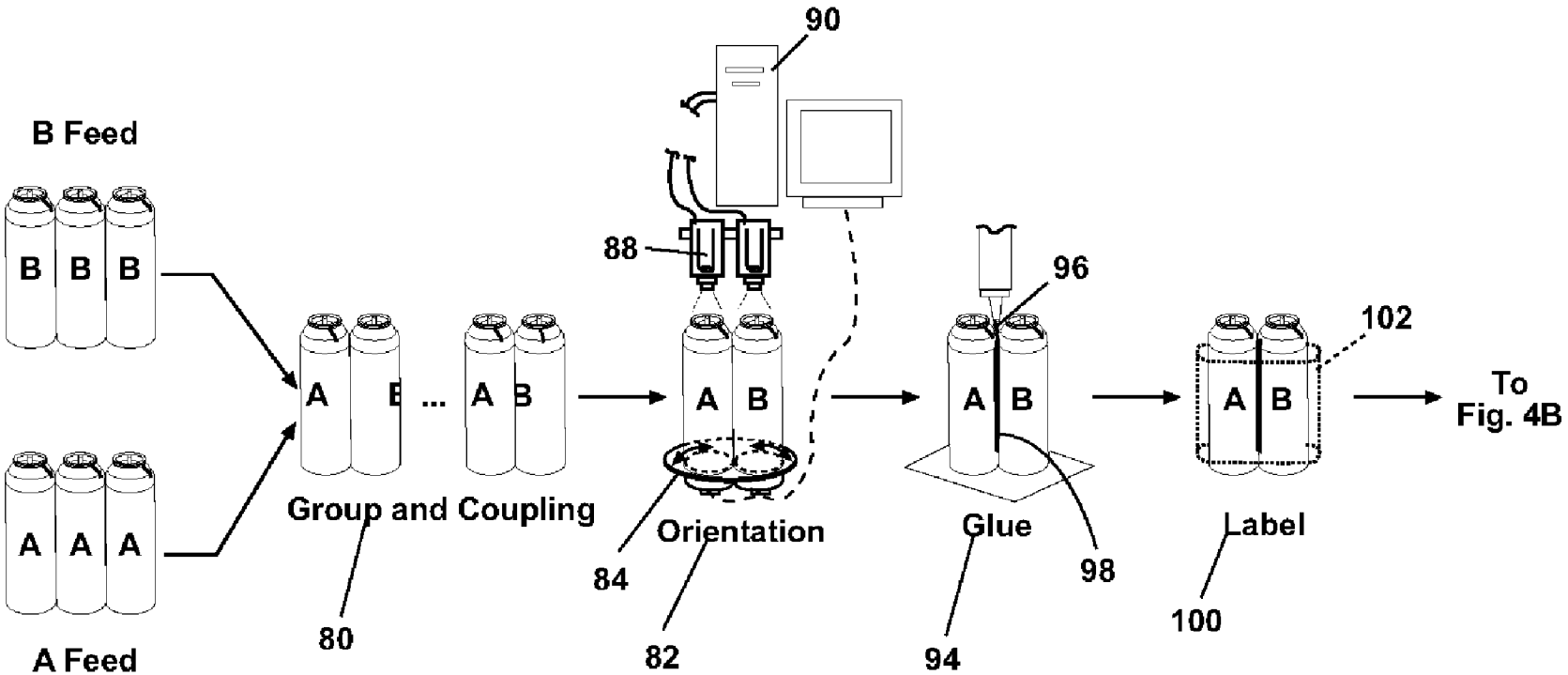
FIG. 4A is a schematic view of a process according to the invention for assembling a manual spray dispenser.
Figure 4B:
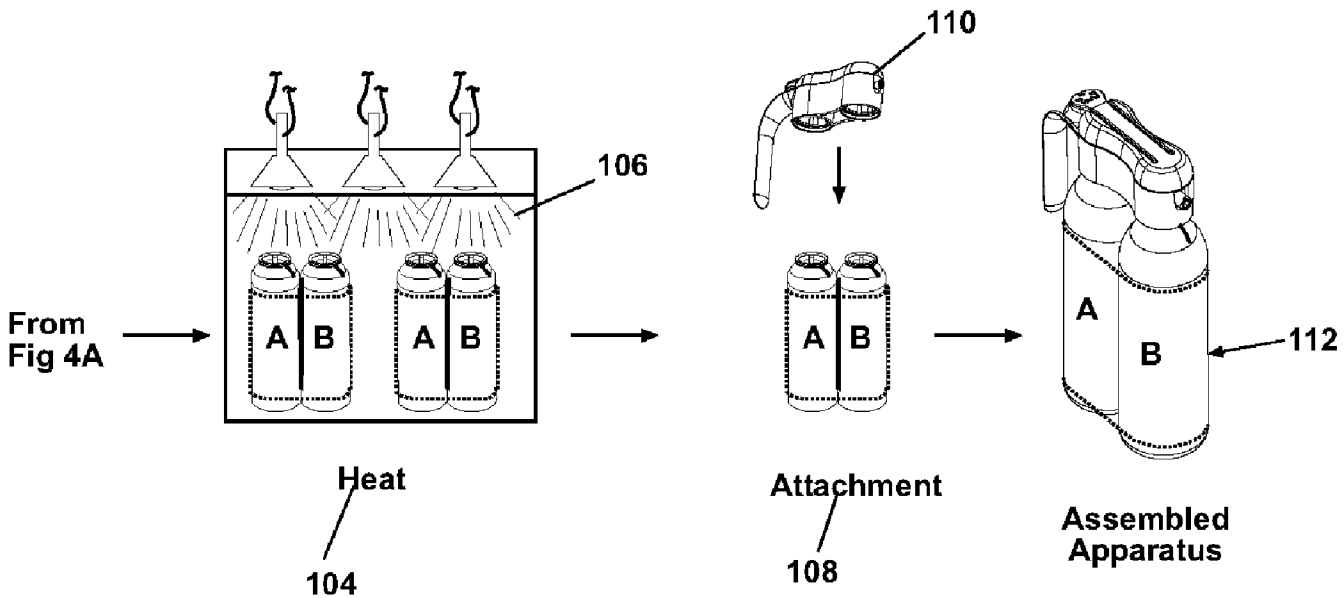
FIG. 4B is a schematic view of a continuation of the process of FIG. 4A.
Figure 5:
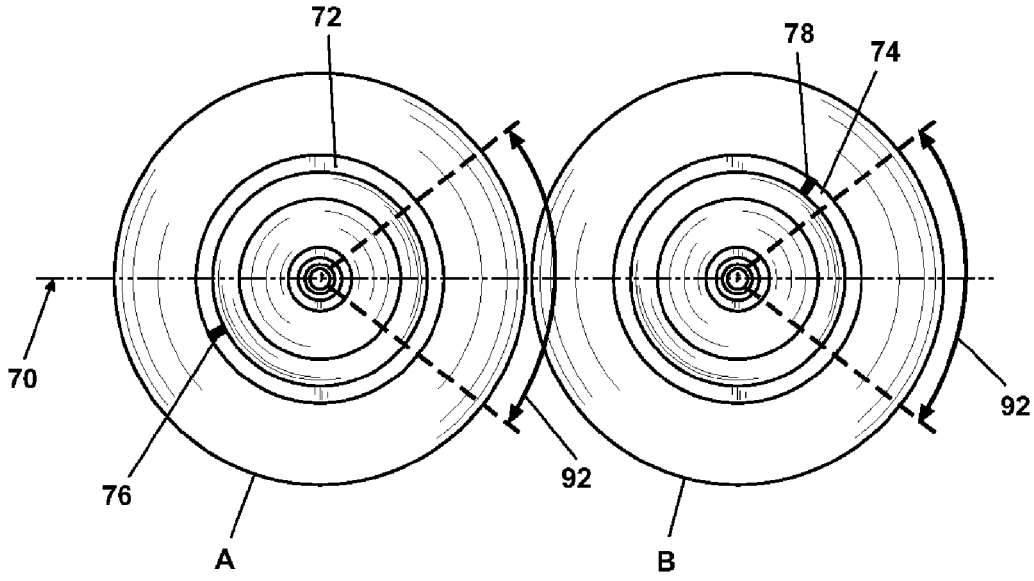
FIG. 5 is a plan view of two adjacent containers in the process of FIGS. 4A and 4B prior to orientation.

FIGS. 4A and 4B illustrate a process of assembling a manual spray dispenser, including an orientation process, according to the invention. Containers prefilled with oxidizing composition (labeled A) and containers prefilled with cleaning composition (labeled B) are fed to a group and coupling step 80 where they are grouped and coupled with each other. Each pair of containers comprises one container A adjacent to one container B with container B in front of container A, i.e., in the direction that will ultimately be toward the front of the assembled manual spray dispenser. Referring now at FIG. 5, each pair of containers A, B will be handled together with reference to an imaginary reference plane 70 intersecting the longitudinal axes of the two adjacent containers during the remaining steps of the assembly process. As described above, each container A, B has a valve cup 72, 74 that will be marked with a visual indicia 76, 78, respectively, representing where the pick up point of the dip tube in each container is located relative to the container.

It is understood that at this point, the visual indicia 76, 78 on the containers is located randomly relative to the imaginary plane 70. In a preferred embodiment, the mark 76 on the valve cup 72 attached to the oxidizing composition container A is distinguishable from the mark 78 on the valve cup 74 attached to the cleaning composition container B by color, e.g., red for the cleaning composition and black for the oxidizing composition. The marks 76, 78 can also contain other distinguishing features for easy identification of the containers' compositions.

Referring again to FIGS. 4A and 4B, the containers A, B, once grouped and coupled, are conveyed to an orientation step 82 where the containers will be oriented relative to each other so that the visual indicia 76, 78 will be aligned relative to the reference plane 70. In the orientation step, each container is mounted on an independently rotatable platform 84, 86. A sensor, preferably one or more cameras 88, detects the position of the visual indicia 76 and/or 78 on each container and generates a location signal representative of the location of the indicia with respect to the reference plane 70. The location signal is transmitted to a microprocessor 90 that compares the location of each indicia relative to the reference plane 70. The microprocessor 90 determines the location of the visual indicia 76 and/or 78 of each container in the pair relative to the reference plane 70. In this case, the microprocessor determines whether or not the location of the visual indicia 76 and/or 78 of each container is within or without a predetermined range of acceptable locations. Referring again to FIG. 5, an acceptable range 92 for a visual indicia on a given container is any location within 45° of the reference plane about the longitudinal axis of the container bearing that visual indicia facing toward the front of the manual spray package with a preferred range of 22.5° from the reference plane. If the visual indicia 76 and/or 78 of a container is outside the acceptable range 92, the microprocessor 90 generates an output signal to an actuator that rotates the platform 84 and/or 86 on which the particular container is mounted until the visual indicia 76 and/or 78 is within the acceptable range 92. Preferably, the orientation step includes sensing both containers simultaneously to orient both adjacent containers A and B simultaneously.

Alternatively, the camera 88 can capture an image of a small section of the container or the valve assembly cup 72 and/or 74. The microprocessor 90 can be programmed to transmit an output signal to the actuator that commands the platform 84 and/or 86 to rotate continuously until the sensed position of the indicia is within the acceptable range. When the indicia 76 and/or 78 is captured within the image, the microprocessor 90, upon recognizing the indicia 76 and/or 78, terminates the rotation signal to the actuator to stop rotation of the platform 84 and/or 86, leaving the container in the proper orientation.

Once the containers A, B are oriented properly within the acceptable range 92, the oriented containers are moved to a glue station 94 at which a conventional glue applying head applies a specified amount of hot glue 96 at a nip point 98 between the containers A, B, i.e., that point where the adjacent containers are closest to one another and perhaps even touching. Preferably, the containers are aluminum and the hot melt glue 96 consists of a well know formula that will adhere to aluminum. After a short curing time, the glue 96 effectively prevents separation of the containers A, B from each other and maintains their orientation relative to the reference plane 70.

From the glue station 94, the adjoined containers A and B are conveyed to a labeling station 100. Here, a preformed tube of labeled shrink-wrap material 102 is cut to a predetermined length and dropped over the pair of containers. The shrink-wrap material 102 comprises a protective wrapping of a plastic film that is wound about the articles and then shrunk by heat to form a sealed, tight-fitting package.

The pair of containers, with the shrink-wrap material 102 loosely sitting around them, is then conveyed to a heat shrink station 104 where, in an oven or a heat tunnel, the application of heat 106 shrinks the shrink-wrap material 102 tightly around the containers A, B. The shrink-wrap material 102 provides additional support holding the containers in their properly oriented positions and can be employed either individually or in combination with the hot glue 96 to secure the containers A, B together.

The bound containers A, B are then conveyed to an attachment station 108 where an actuator 110 is press-fit onto the valve cups 72, 74 of the containers A, B, further securing the containers together and providing a nozzle for dispensing of the cleaning solution from the assembled manual spray dispenser 112 as disclosed in U.S. patent application Ser. No. 10/604,780.

Reasonable variation and modification are possible within the scope of the foregoing disclosure and drawings without departing from the spirit of the invention which is described in the appended claims.

What is claimed is:

1. A process of orienting adjacent aerosol containers relative to a reference plane, wherein each container has a valve stem, a dip tube, a pick up point on the dip tube within the container and a longitudinal axis lying in the reference plane, the process comprising the steps of:

marking each container with a visual indicia at a predetermined relationship to the pick up point;

detecting the position of the visual indicia relative to the reference plane; and rotating each container until the visual indicia is within a predetermined oriented relationship to the reference plane.

2. A process of orienting adjacent aerosol containers relative to a reference plane according to claim 1 and further comprising the step of securing two adjacent aerosol containers together in the predetermined oriented relationship to the reference plane.

3. A process of orienting adjacent aerosol containers relative to a reference plane according to claim 2 wherein the securing step includes gluing the containers together.

4. A process of orienting adjacent aerosol containers relative to a reference plane according to claim 3 wherein the securing step further includes the step of binding the containers together with a shrink-wrap material.

5. A process of orienting adjacent aerosol containers relative to a reference plane according to claim 2 wherein the securing step includes the step of binding the containers together with a shrink-wrap material.

6. A process of orienting adjacent aerosol containers relative to a reference plane according to claim 1 wherein the predetermined relationship is within about 45° of the reference plane.

7. A process of orienting adjacent aerosol containers relative to a reference plane according to claim 6 wherein the predetermined relationship is within about 22° of the reference plane.

8. A process of orienting adjacent aerosol containers relative to a reference plane according to claim 1 wherein the longitudinal axes of the adjacent aerosol containers lie within the reference plane and the containers are oriented so that the visual indicia of each of the adjacent containers are aligned in the same direction.

9. A process of orienting adjacent aerosol containers relative to a reference plane according to claim 8 and further comprising the step of securing two adjacent aerosol containers together in the predetermined relationship to the reference plane.

10. A process of orienting adjacent aerosol containers relative to a reference plane according to claim 9 and further comprising the step of applying to the valve stems of the adjacent containers a dispensing actuator that has a dispensing opening that is directed along the reference plane.

* * * * *